United States Patent [19]

John

[11] Patent Number: 4,957,255

[45] Date of Patent: Sep. 18, 1990

[54] VALANCE SUPPORT BRACKET

[75] Inventor: Julius F. John, Redondo Beach, Calif.

[73] Assignee: Home Fashions, Inc., Santa Monica, Calif.

[21] Appl. No.: 316,652

[22] Filed: Feb. 28, 1989

[51] Int. Cl.[5] ..... E06B 9/00

[52] U.S. Cl. ..... 248/222.3; 160/38; 160/902

[58] Field of Search ..... 248/222.2, 222.3, 229, 248/231.8, 316.7; 16/87.2, 87.4 R, 94 D; 160/19, 38, 39, 178.1, 902

[56] References Cited

U.S. PATENT DOCUMENTS

| | | | |
|---|---|---|---|
| 2,204,937 | 6/1940 | Larrison | 160/19 X |
| 2,660,237 | 11/1953 | Bopp et al. . | |
| 3,129,751 | 4/1964 | Weber | 248/222.3 X |
| 3,169,006 | 2/1965 | Lorentzen et al. . | |
| 3,291,194 | 12/1966 | Kirtley et al. | 16/94 D |
| 3,715,776 | 2/1973 | Tanaka | 16/94 D |
| 4,224,974 | 9/1980 | Anderson et al. . | |
| 4,254,814 | 3/1981 | Vecchiarelli | 160/38 X |
| 4,399,856 | 8/1983 | Anderson | 160/39 |
| 4,411,401 | 10/1983 | Anderson . | |
| 4,475,706 | 10/1984 | Anderson . | |
| 4,607,818 | 8/1986 | Georgopoulos . | |
| 4,662,421 | 5/1987 | Basmadji et al. | 160/38 |
| 4,719,955 | 1/1988 | Tachikawa et al. . | |

FOREIGN PATENT DOCUMENTS

| | | | |
|---|---|---|---|
| 2264682 | 10/1974 | Fed. Rep. of Germany | 160/178.1 |
| 866800 | 5/1961 | United Kingdom | 160/39 |

*Primary Examiner*—David M. Purol
*Assistant Examiner*—Robert A. Olson
*Attorney, Agent, or Firm*—Welsh & Katz, Ltd.

[57] ABSTRACT

A valance support bracket for mounting on the headrail of a venetian blind to enable mounting of a valance. The headrail has a pair of laterally spaced coplanar mounting flanges extending longitudinally along its upper surface. The valance support bracket includes a mounting plate from which depends a pair of locking arms adapted to be inserted downwardly between the mounting flanges on the headrail when the valance support bracket is disposed in a first orientation, the locking arms being further adapted for cooperative relation with the mounting flanges so as to cause the valance support bracket to undergo a snap-action movement as it is moved to a second orientation substantially perpendicular to the longitudinal axis of the headrail wherein the locking arms effect locking relation with the headrail.

10 Claims, 1 Drawing Sheet

VALANCE SUPPORT BRACKET

BACKGROUND OF THE INVENTION

The present invention relates generally to valance brackets, and more particularly to a novel valance support bracket which may be readily releasably mounted on a headrail or guide channel such as employed in horizontal or vertical venetian blinds.

Venetian blinds of both the horizontal and vertical louver styles conventionally employ an elongated headrail or guide channel which is generally supported in a horizontal position from a support surface such as a horizontal header above a window, a vertical wall, or a horizontal ceiling surface. The headrail or guide channel may be rectilinear or curved and generally supports and conceals an operating mechanism which in turn supports and enables manipulation of louvers such that, in the case of horizontal louvers, the louvers may be rotated about their longitudinal axes and selectively raised and lowered, while in the case of vertical louvers, the operating mechanism enables both rotation of the louvers about their vertical longitudinal axes and traverse along the headrail between open and closed blind positions. Because the headrail or guide channel and the associated connections of the louvers to the headrail supported louver operating mechanism generally detract from the desired appearance of the overall venetian blind assembly, it is a common practice to mount a valance along the exposed surface of the headrail so as to conceal the headrail and louver connections and thereby present more aesthetically pleasing appearance. The valance is generally secured to the headrail by a plurality of valance support brackets which are mounted in spaced relation on the headrail. Ideally, the valance support brackets enable relatively simple releasable attachment to the headrail by an installer at the job site without need for special tools or the like.

SUMMARY OF THE INVENTION

The present invention addresses the problem of mounting valance support brackets on a headrail or guide channel of a venetian blind so as to enable the valance support brackets to be releasably affixed to the headrail at substantially any desired position along its length. In accordance with the invention, a novel valance support bracket is provided which is particularly adapted for releasable mounting on a venetian blind headrail or guide channel having along its upper surface a pair of longitudinally extending mutually opposed coplanar mounting flanges. The valance support bracket has a mounting plate portion from which depends a pair of locking arms adapted to be inserted downwardly between the mounting flanges on the headrail when the valance support bracket is disposed in a first orientation, the locking arms being further adapted to undergo a releasable snap-action locking relation with the headrail when the valance support bracket is moved to a second orientation having its longitudinal axis substantially normal to the longitudinal axis of the headrail so as to releasably retain the valance support bracket in mounted relation thereon. Should it become desirable to reposition the valance mounting bracket, it is simply rotated to release the locking arms from the headrail which enables removal or repositioning.

Accordingly, one of the primary objects of the present invention is to provide a novel valance support bracket for use with an elongated headrail or guide channel of a venetian blind to facilitate mounting of a valance on the headrail.

A more particular object of the present invention is to provide a novel valance support bracket which finds particular application with a venetian blind headrail or guide channel of the type having a pair of longitudinally extending mutually facing coplanar mounting flanges formed along its upper surface, the valance support bracket having a pair of locking arms adapted to be received between the mounting flanges when the valance support bracket is in a first angled orientation relative to the headrail, and which upon rotating the valance support bracket to a position substantially normal to the axis of the headrail causes the locking arms to undergo a snap-action locking engagement with the headrail adjacent the mounting flanges so as to releasably maintain the valance support bracket in mounted relation on the headrail.

A still further object of the present invention is to provide a novel valance support bracket as aforedescribed which is economical to manufacture and which may be readily installed by a relatively unskilled person without need for special tooling or the like.

Further objects and advantages of the present invention, together with the organization and manner of operation thereof, will become apparent from the following detailed description of the invention when taken in conjunction with the accompanying drawing wherein like reference numerals designate like elements throughout the several views.

DETAILED DESCRIPTION

Figures 1, 2, 3, 4, 5:
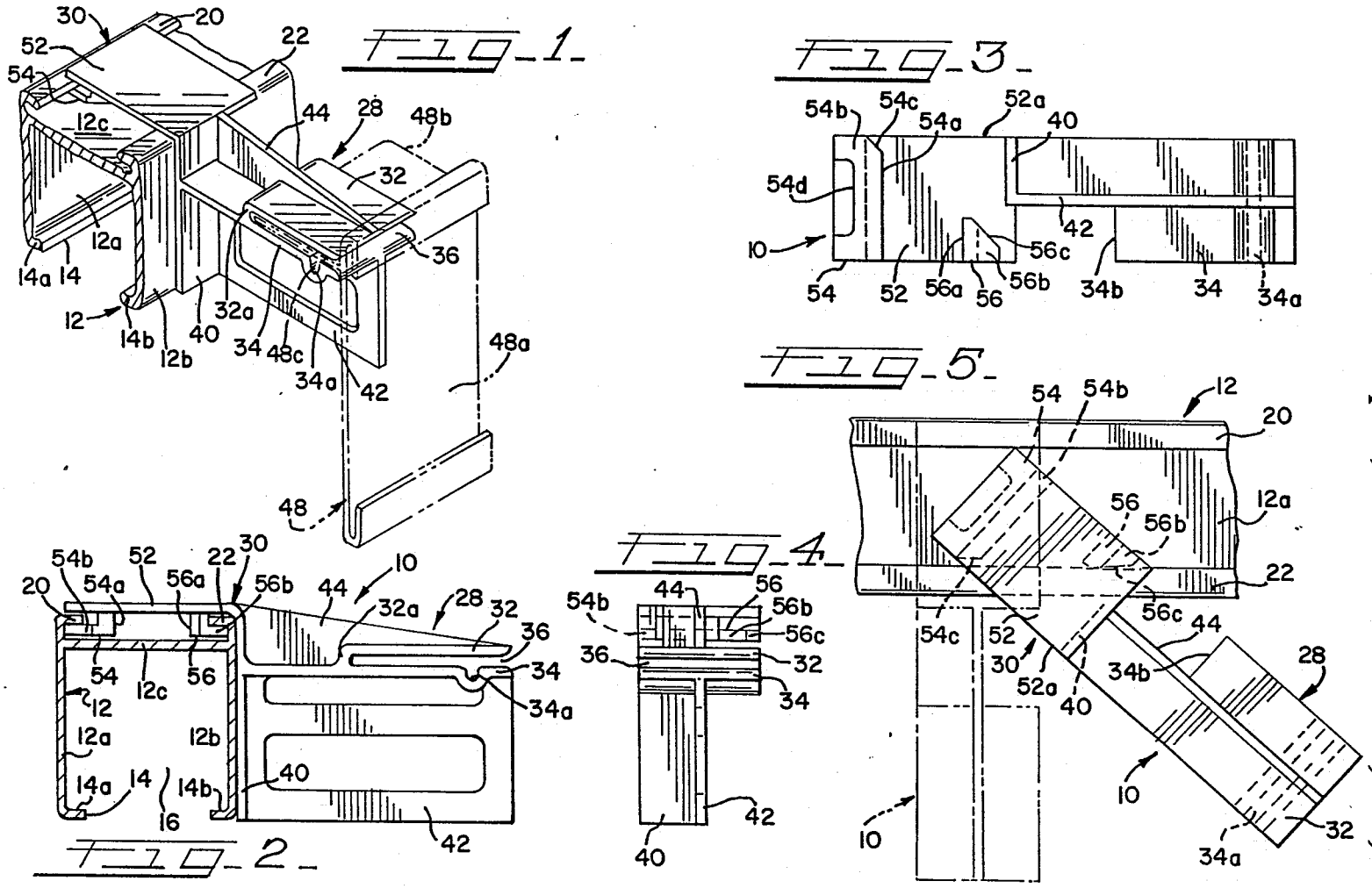
FIG. 1 is a fragmentary perspective view illustrating a valance support bracket in accordance with the present invention mounted on a venetian blind headrail, a fragmentary portion of a valance being shown in phantom mounted on the valance support bracket.
FIG. 2 is a side elevational view of the valance support bracket of FIG. 1 mounted on the headrail.
FIG. 3 is a bottom view of the valance support bracket of FIG. 2 removed from the headrail.
FIG. 4 is an end view of the valance support bracket of FIG. 2.
FIG. 5 is a fragmentary plan view illustrating the technique for mounting the valance support bracket of FIG. 2 on a headrail or guide channel of a venetian blind.

Referring now to the drawing, a valance support bracket constructed in accordance with a preferred embodiment of the present invention is indicated generally at 10. As will be more fully described, the valance support bracket 10 is adapted for releasable mounting on an elongated headrail or guide channel, indicated generally at 12, of the type which may be employed with horizontal or vertical type venetian blinds The headrail 12 may be formed from extruded aluminum or the like and is of substantially rectangular transverse cross-sectional configuration having side walls **12*a* and 12*b* maintained in parallel laterally opposed relation by a transverse web or wall 12*c*. The lower edges of the sidewalls 12*a* and 12*b* terminate in inwardly directed mutually opposed coplanar flanges 14*a* and 14*b* which establish the lower surface of the headrail and define a longitudinally extending access opening 14 to a rectangular chamber 16 which extends substantially the full longitudinal length of the headrail Chamber 16** receives and conceals operating mechanism (not shown) for supporting and manipulating either horizontal or vertical louvers (not shown) as employed, respectively, in horizontal and vertical venetian blinds of conventional design.

The headrail or guide channel 12, which may alternatively be termed a guide track, has a mounting channel formed along its upper surface defined by the transverse web **12*c* and a pair of longitudinally extending laterally spaced coplanar mounting flanges 20 and 22. The mounting flanges 20 and 22 may be formed integral with the upper edges of the headrail sidewalls 12*a* and 12*b*, respectively, and are of equal transverse width. The mounting channel and associated mounting flanges 20 and 22 facilitate mounting of the headrail or guide channel 12** through support brackets (not shown) to a support surface such as a horizontal or angled header surface above a window, or to a vertical wall or the like, in a manner as disclosed in pending U.S. Pat. application Ser. No. 196,134, filed May 19, 1988, which is incorporated herein by reference.

The valance support bracket 10 may be formed as a unitary construction from a suitable strength plastic material, such as Delrin or other nylon, high density polyethylene, or polyvinylchloride or the like, and includes a valance support end portion 28 and a mounting end portion 30. The valance support end portion 28 is similar to the valance support portion of the valance bracket disclosed in the aforementioned pending U.S. Pat. application, Ser. No. 196,134, and includes a pair of generally parallel valance mounting plates 32 and 34 which define a slot or recess 36 therebetween open at its outer end and closed at its inner end by a wall **32*a* interconnecting upper plate 32 to plate 34. Plate 34 extends perpendicular from a planar wall 40. A generally rectangular reinforcing rib or strut 42 has its rearward and upper marginal edges connected, respectively, in normal relation to the wall 40 and to the lower surface of plate 34 along its longitudinal center axis so as to maintain plate 34 in generally rigid relation to wall 40. A rib 44 also has its rearward marginal edge connected to wall 40 and has a lower marginal edge connected to and extending along the longitudinal axis of the upper surfaces of plates 34 and 32 so as to enable limited flexibility of plate 32 relative to plate 34**.

The valance support end portion 28 of the valance support bracket 10 may take alternate forms which are operative to support a valance In the illustrated embodiment, a valance is indicated in phantom at 48 in FIG. 1 and has a generally planar wall **48*a* to which is affixed a rearwardly extending mounting flange 48*b* adapted to be inserted within the slot or recess 36 in the valance support end portion 28 of the valance support bracket. Preferably, a depending rib 48*c* is formed longitudinally along the lower surface of the mounting flange 48*b* for nesting within a correspondingly configured recess 34*a* formed in the plate 34 so as to releasably retain the valance mounted on the valance support bracket. The planar wall 48*a* of the valance preferably has a vertical height sufficient to conceal the headrail 12** and support mechanism for the associated louvers.

The mounting end portion 30 of the valance support bracket 10 includes wall 40 and an upper mounting plate 52 preferably formed integral with the wall 40 so as to form a 90° or right-angle mounting bracket. The wall 40 has a vertical height substantially similar to the height of the corresponding headrail sidewall **12*b*, and the mounting plate 52 has a longitudinal length generally equal to the distance between the outer surfaces of the headrail sidewalls 12*a* and 12*b*. Referring to FIGS. 2–5, a pair of locking arms 54 and 56 are affixed to and depend from the mounting plate 52 and are adapted to be inserted downwardly between the laterally spaced mounting flanges 20 and 22 formed along the upper surface of the headrail when the valance support bracket is disposed in a first angled orientation relative to the longitudinal axis of the headrail, as illustrated in solid lines in FIG. 5. The locking arms 54 and 56 are further adapted to undergo a snap-action movement, when the valance support bracket is rotated to a second orientation substantially perpendicular to the longitudinal axis of the headrail, as illustrated in phantom in FIG. 5, during which the locking arms effect releasable locking engagement with the headrail sidewalls adjacent the mounting flanges 20 and 22**.

The locking arms 54 and 56 are of generally L-shaped configuration, when the valance support bracket is viewed in side elevational as in FIG. 2. To this end, the locking arm 54 has a depending wall **54*a* and a locking flange 54*b* spaced below and parallel to plate 52. The locking flange 54*b* is mitered or beveled at a corner 54*c* and may also have a recess 54*d* formed therein. The locking arm 56 includes a depending wall 56*a* and a locking flange 56*b* which is coplanar with the locking flange 54*b*. The locking flange 56*b* has a mitered or angled corner surface 56*c* which lies in a common plane with the mitered edge 54*c* of locking arm 54, such plane forming an included angle of approximately 45° with a plane normal to mounting plate 52 and parallel to wall 40. The locking flanges 54*b* and 56*b* cooperate with their corresponding walls 54*a* and 56*a* and the mounting plate 52 to define locking channels which extend transversely of the mounting plate and receive the mounting plates 20 and 22**.

Referring to FIGS. 3 and 4, the wall 40 has a transverse width approximately ½ the transverse width of the mounting plate 52, and extends from a lateral edge **52*a* of the mounting plate to the reinforcing strut 42. The rearward end of plate 34 on the side of strut 42 corresponding to locking arm 56 is terminated at an end surface 34*b*. By limiting the lateral extent of mounting wall 40 and terminating the valance support plate 34 at 34*b*, and by mitering the corners 54*c* and 56*c* of the locking flanges 54 and 56, the valance support bracket may be positioned such that its longitudinal axis subtends an angle of approximately 45° with the longitudinal axis of the headrail 12, as shown in solid lines in FIG. 5, and manipulated to insert the locking arms 54 and 56 downwardly between the mounting flanges 20 and 22 until the plate 52 engages the upper surface of the mounting flange 22. Thereafter, the valance support bracket may be rotated to a fully mounted position wherein its longitudinal axis is substantially perpendicular to the longitudinal axis of the headrail causing the mounting flanges 20 and 22 to be received in the locking channels between the locking flanges 54*b* and 56*b* and the associated plate 52. In this position, the wall 40 lies flat against the sidewall 12*b*** of the headrail.

The locking flanges **54*b* and 56*b* are spaced from plate 52 a distance substantially equal to the thickness of the mounting flanges 20 and 22 to effect frictional engagement between the locking flanges 54*b* and 56*b* and the mounting flanges 20 and 22, respectively, when the valance support bracket is pivoted to its fully mounted position. The depending walls 54a and 56a of the locking arms 54 and 56, respectively, are spaced laterally apart so that as the valance support bracket is rotated to its fully mounted position transverse to the headrail, the mounting plate 52 bows upwardly and the valance support bracket undergoes a snap-action pivotal movement until the locking arm walls 54a and 56a confront the inwardly facing edges of the mounting flanges 20 and 22, respectively. The locking flanges 54b and 56b are configured such that their free ends engage the corresponding headrail sidewalls 12a and 12b below the mounting flanges 20 and 22 in an interference fit which is sufficient to maintain mounting plate 52 in a slightly upwardly bowed condition to forcefully bias the free ends of the locking flanges against their corresponding headrail sidewalls. Such interference fit frictionally maintains the valance support bracket in generally fixed relation on the headrail so as to resist sliding along the headrail. By making the valance support bracket from a plastic material, such as Delrin, the mounting plate 52 can undergo such bowing during mounting on the headrail and thereafter bias the free ends of the locking flanges against the headrail sidewalls 12a and 12b as the valance support bracket is pivoted from an angled position to a fully mounted position perpendicular to the headrail. It will be appreciated that the valance support bracket 10** may be released from the headrail by reversing the aforedescribed mounting procedure.

While a preferred embodiment of the present invention has been illustrated and described, it will be understood that changes and modifications may be made therein without departing from the invention in its broader aspects. Various features of the invention are defined in the following claims.

What is claimed is:

1. A valance support bracket for mounting on a headrail of a venetian blind wherein the headrail has a mounting channel defined by a pair of laterally spaced mutually facing mounting flanges extending longitudinally along an external surface, said valance support bracket comprising a valance support end portion and a headrail mounting end portion, said headrail mounting end portion including a mounting plate having a longitudinal axis and a pair of locking arms defining a pair of generally parallel locking flanges fixed to and spaced from said mounting plate in generally transverse relation thereto, one of said locking flanges having less transverse length than the other locking flange to enable insertion of said locking flanges between the mounting flanges into said mounting channel when the mounting plate is disposed with its longitudinal axis in a first angular orientation of approximately 45° relative to the longitudinal axis of the headrail, said locking arms being further adapted to receive said mounting flanges between said locking flanges and said mounting plate for releasable locking relation with said headrail when the valance support bracket is rotated generally within the plane of said mounting plate to a second orientation wherein the longitudinal axis of said mounting plate is substantially perpendicular to the longitudinal axis of the headrail, said locking flanges having oppositely directed free ends adapted to frictionally engage the headrail when said valance support bracket is in said second orientation, and a wall fixed to said mounting plate at right angles thereto, said wall being adapted to engage a sidewall of the headrail so as to limit rotation of said support bracket during movement to said second orientation.

2. A valance support bracket as defined in claim 1 wherein said locking arms are of generally L-shaped.

3. A valance support bracket as defined in claim 1 wherein said locking arms depend from said mounting plate and define locking channels extending transverse to said mounting plate.

4. A valance support bracket as defined in claim 1 wherein said locking arms define coplanar locking flanges having mitered corner edge surfaces to enable insertion of said locking arms between said mounting flanges when the valance support bracket is disposed in said first angular orientation relative to the headrail.

5. A valance support bracket as defined in claim 1 wherein said mounting plate and locking arms are cooperative with said headrail to effect a snap-action movement of the support bracket as it is moved to said second orientation.

6. A valance support bracket as defined in claim 5 wherein said mounting plate and locking arms are cooperative with said headrail to effect an upward bowing of said mounting plate as the support bracket is moved to said second orientation, said bowed mounting plate being operative to bias the free ends of said locking flanges against the headrail when said support bracket is in said second orientation.

7. A valance support bracket as defined in claim 1 wherein said mounting plate has a longitudinal axis and a transverse axis, said wall having a transverse axis parallel to the transverse axis of said mounting plate and having a transverse width less than the transverse width of said mounting plate.

8. A valance support bracket as defined in claim 7 wherein said wall has a transverse width equal to approximately ½ the transverse width of said mounting plate.

9. A valance support bracket as defined in claim 7 wherein each of said locking flanges has a mitered corner lying in a plane containing the mitered corner of the other locking flange so as to enable insertion of said locking arms between said mounting flanges when said support bracket is in said first orientation relative to said headrail.

10. A valance support bracket as defined in claim 9 wherein said valance support end portion includes a pair of substantially parallel valance support plates each lying in a plane substantially normal to said wall, said support plates being configured to enable said first angular orientation of said valance support bracket relative to said headrail.

* * * * *